US005782456A

United States Patent [19]

Brosius et al.

[11] Patent Number: 5,782,456

[45] Date of Patent: Jul. 21, 1998

[54] VEHICLE JACK

[75] Inventors: Peter Brosius, Ayl; Ludger Hilvert, Irsch; Andreas Huber, Braunschweig; Ferdinand Alten, Mandern, all of Germany

[73] Assignee: August Bilstein GmbH, Ennepetal, Germany

[21] Appl. No.: 666,078

[22] Filed: Jun. 19, 1996

[30] Foreign Application Priority Data

Jun. 20, 1995 [DE] Germany ..... 195 21 994.5
Nov. 22, 1995 [DE] Germany ..... 195 43 523.0

[51] Int. Cl.[6] ..... B66F 3/12

[52] U.S. Cl. ..... 254/126

[58] Field of Search ..... 254/DIG. 1, DIG. 4, 254/122, 124, 126, 7 R, 95, 131, 96

[56] References Cited

U.S. PATENT DOCUMENTS

| | | | |
|---|---|---|---|
| 2,233,222 | 2/1941 | Paton | 254/95 |
| 4,093,182 | 6/1978 | Rutenbeck | 254/126 |
| 4,194,725 | 3/1980 | Erschens | 254/126 |
| 4,765,595 | 8/1988 | Alten | 254/126 |
| 5,125,627 | 6/1992 | Ipekbayrak et al. | 254/126 |
| 5,460,352 | 10/1995 | Calafi | 254/126 |

FOREIGN PATENT DOCUMENTS

| | | | |
|---|---|---|---|
| 2134075 | 1/1983 | United Kingdom | 254/126 |
| 2199301 | 7/1988 | United Kingdom | 254/7 R |

*Primary Examiner*—Robert C. Watson
*Attorney, Agent, or Firm*—Max Fogiel

[57] ABSTRACT

A vehicle jack with an upright assembly and an arm articulated thereto around a fixed horizontal axis. The free end of the arm bends toward the vehicle and is directly or indirectly raised away from and lowered toward the ground by a spindle. To simplify obtaining an angle in the arm, the main section of the arm is straight and an angled section is form fit onto its free end.

14 Claims, 3 Drawing Sheets

VEHICLE JACK

BACKGROUND OF THE INVENTION

The present invention concerns a jack with an upright assembly and an arm articulated thereto.

Jacks are employed to raise automobiles in the event of a flat tire to replace the wheel with a spare. Jacks are accordingly to some extent dangerous to handle because they can injure the user if they malfunction. Still, given the reliability of contemporary tires, jacks are seldom required, and they spend most of the vehicle's life as nothing but added weight. Jacks must accordingly be not only reliable enough for safe use but also light in weight and inexpensive.

German 7 801 157 U1 discloses a jack which, to ensure that a jack that is as small as possible can be employed with vehicles in small areas to raise a vehicle as high as possible, the free end of the arm is bent toward the vehicle. The arm is conventionally constructed of sheet metal and is accordingly complicated to manufacture and uses a lot of material.

German 7506 553 U addresses a similar object. It includes a leg comprising an appropriately bent foot welded to an upright column. This jack is complicated to manufacture, and the weld must be carefully inspected because it is exposed to considerable stress. Thus, German 7 801 157 U1 discloses a jack with an upright assembly and an arm articulated thereto around a fixed horizontal axis. The free end of the arm bends toward the vehicle and is directly or indirectly raised away from and lowered toward the ground by a spindle. To simplify obtaining an angle in the arm, the main section of the arm is as disclosed in the present application, straight, and an angled section (15) is form fit onto its free end. Such jacks are simple enough to facilitate manufacturing various versions. Since the angled section can be manufactured and stocked separate from the rest of the jack, it is easy to combine with jacks of different design and vice versa even at a later date. Various angled sections can accordingly be used in a jack of a prescribed lift in accordance with the type of sill weld and with the available footprint. Finally, the jack can be assembled once the two main parts have been completed and lacquered.

One advantageous improvement of the jack described in the present application constitutes a base plate that tilts around an axis at the bottom of the upright assembly and paralleling the axis of articulation between the arm and the upright assembly. The design diminishes pressure on the base.

providing a conventional jack with an angled section on the arm that can be adjusted to the shape of the vehicle at the jack-application point is advantageous. The jacks of that type have a rigid point of contact with the ground, however. When such a jack is incorrectly introduced below the vehicle, the load-transmission point can migrate out of the cone of friction in relation to the point of contact between the jack and the ground. This can be dangerous. The jack can slip out from under the vehicle and injure the user.

SUMMARY OF THE INVENTION

An object of the present invention is to improve a jack in which the angle in the arm can be produced by simple means.

Another object of the present invention is accordingly to improve the jack to the extent that it will always be reliably position below the vehicle with due consideration to the extreme situations of loaded vehicle with defective tire and empty vehicle with full tire, the load-transmission point remaining within the cone of friction in relation to the point of contact between the jack and the ground.

The present invention provides many advantages. The jack can be easily manufactured with an angled arm. The arm can be made of various materials. The main arm for instance can be aluminum with an angled section of steel. The steel will be necessary if the angled section incorporates a rotating flange that must be welded. It is on the other hand also conceivable for the angled section to be plastic, injection-molded for example. Again, jacks in accordance with the present invention are simple enough to facilitate manufacturing various versions. Since the angled section can be manufactured and stocked separate from the rest of the jack, it is easy to combine with jacks of different design and vice versa even at a later date. Various angled sections can accordingly be used in a jack of a prescribed lift in accordance with the type of sill weld and with the available footprint. Finally, the jack can be assembled once the two main parts have been completed and lacquered.

Jacks of the type corresponding to the second object, have an even wider range of variation, and not as many types of main section will be necessary. This is because the load-transmission point is always ideally positioned above the ground-contact point.

BRIEF DESCRIPTION OF THE DRAWINGS

Embodiments of the present invention will now be specified with reference to the accompanying drawing, wherein.

DESCRIPTION OF THE PREFERRED EMBODIMENTS

Figure 1:
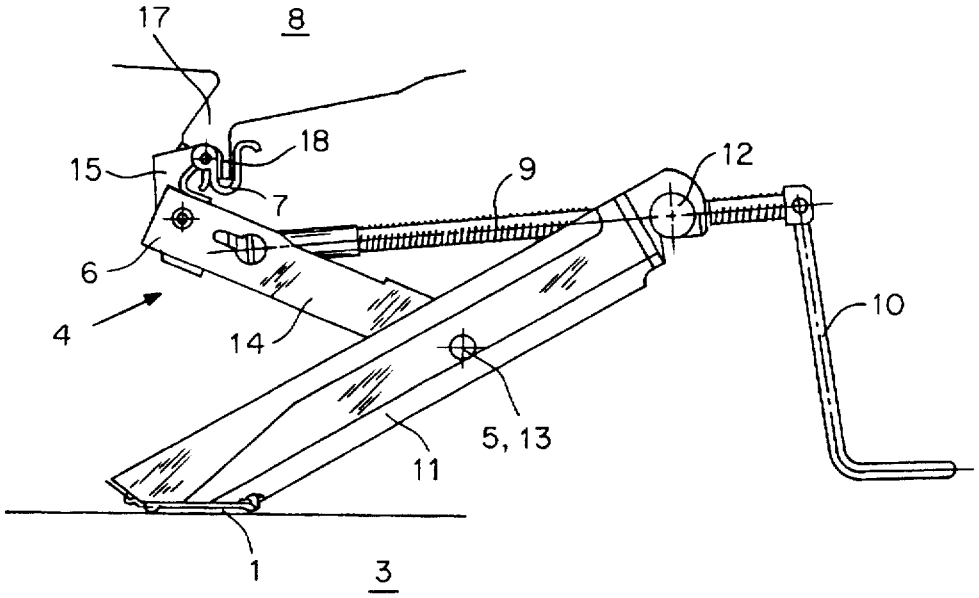
FIG. 1 illustrates a single-arm articulated jack.
Figure 2:
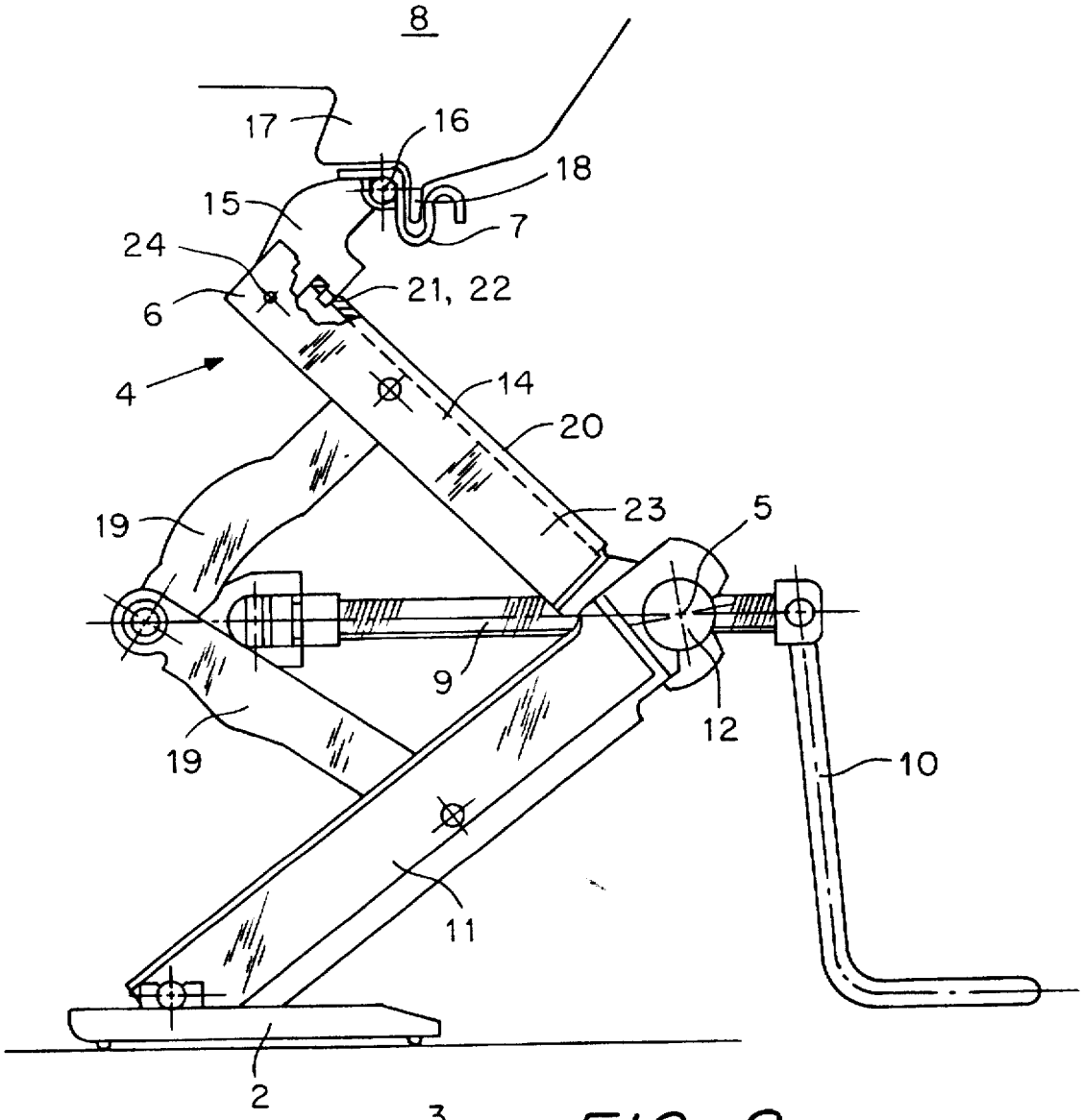
FIG. 2 illustrates a double-articulated jack.

The jack illustrated in FIG. 1 rests against the ground 3 on a conventional foot 1, and the one illustrated in FIG. 2 on a conventional base plate. The actual upright assemblies differ in design. Jacks of the overall genus of interest in the present case, however, incorporate an arm 4 that pivots on the upright assembly around a horizontal axis 5. Mounted on the free end 6 of arm 4 is a stationary or moving accommodation 7 that rests against an appropriate point, floor 8 for example, on the vehicle or engages an opening therein. A crank 10 turns a spindle 9, raising and lowering the free end 6 of arm 4 in relation to ground 3.

FIG. 1 illustrates a single-arm articulated jack. The upright assembly essential comprises a leg 11 with rigidly mounted foot 1 at the bottom. The other end of leg 11 accommodates a rotating nut 12 that operates in conjunction with spindle 9. Arm 4 pivots approximately half-way up leg 11 around an articulation 13 in the form of a horizontal axis 5. One end of spindle 9 engages arm 4, and crank 10 is attached to the other end.

The main section 14 of arm 4 is straight, and an angled section 15 is applied to the arm's free end 6. Accommodation 7 pivots around a bolt 16 that extends through the angled section 15 of arm 4. Accommodation 7 engages the bottom of the vehicle's sill 17 when the vehicle is raised. Accommodation 7 engages the sill seam 18, ensuring unexceptionable contact between accommodation 7 and sill 17.

The double-articulation jack illustrated in FIG. 2 is essentially more complicated than the single-arm articulated jack illustrated in FIG. 1. Leg 11 rests against ground 3 on a rotating foot with a base plate 2, considerably decreasing the pressure on the ground. Arm 4 is articulated to the upper end of leg 11 in the vicinity of the nut 12 that operates in conjunction with spindle 9. The lift, introduced by way of spindle 9 and crank 10, is transmitted by way of a four-point linkage 19 appropriately articulated to leg 11 and arm 4. The main section 14 of arm 4 is a length of U-shaped structural sheet-metal section. The web 20 of the U faces outward. A rib 21 engages a transverse slot 22 in web 20, securing angled section 15 to the main section 14 of arm 4. The angled section 15 of arm 4 fits between the sides 23 of the U-shaped section at the free end of main section 14. A rivet 24 provides additional security and positioning for angled section 15 and main section 14.

A accommodation 7 pivots, as in the embodiment illustrated in FIG. 1, on angled section 15.

Figure 3:
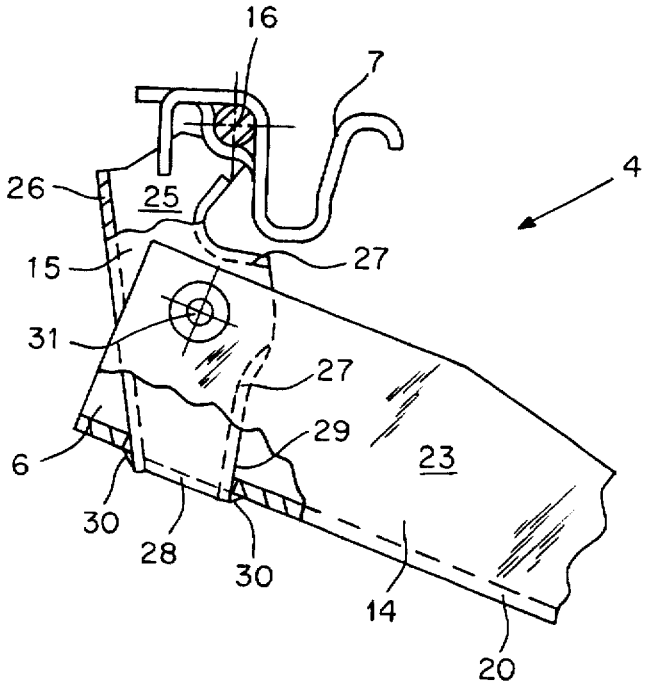
FIG. 3 is a larger-scale illustration of the end of the arm in the embodiment illustrated in FIG. 1.

FIG. 3 illustrates one type of angled section 15 and how it can be attached to the free end 6 of the main section 14 of an arm 4 like that illustrated in FIG. 1. Main section 14 is again a length of U-shaped section, although web 20 is down in FIG. 1. The angled section 15 in the present embodiment is also a strip of sheet metal with an essentially U-shaped cross-section with sides 25 connected by a web 26.

The edges of sides 25 are reinforced with flanges 27. The lower end 28 of angled section 15 extends through a breach 29 in the web 20 of main section 14. At the lower end 28 of angled section 15 are teeth 30 that are forced together when angled section 15 is inserted into main section 14 through breach 29 until they engage the bottom of web 20. Angled section 15 can thereafter no longer be extracted from main section 14 without tools. The angle between main section 14 and angled section 15 is secured with a hollow rivet 31 that extends through bores in both parts and fastens them together.

Both the main section 14 of arm 4 and the leg 11 in the embodiments specified herein are made of aluminum to reduce weight. To facilitate the articulation of accommodation 7, which can be of any material, to arm 4, angled section 15 is made of steel. Such a combination of materials allows technologically simple and reliable attachment of bolt 16 to the sides 25 of angled section 15 by welding.

Figure 4:
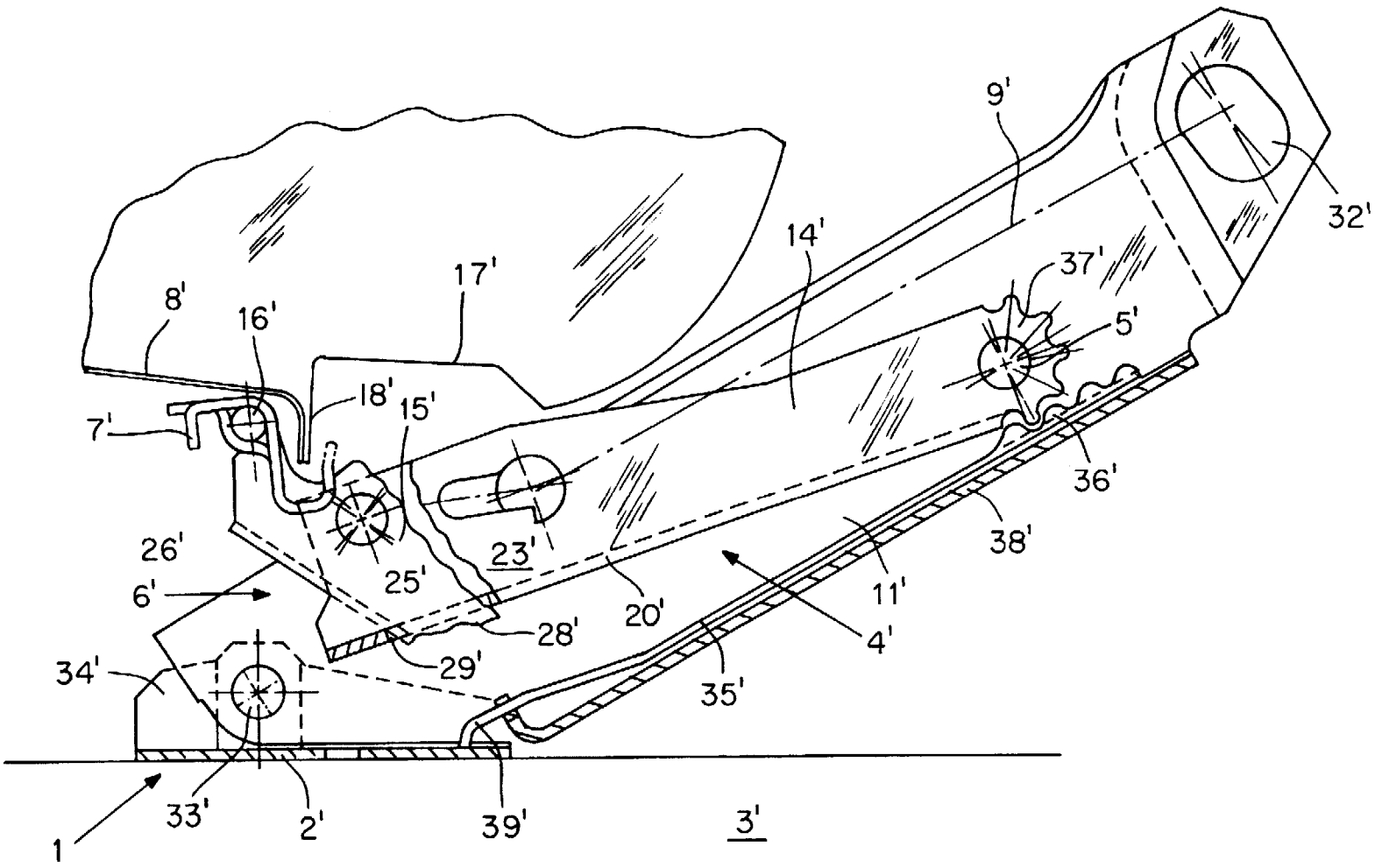
FIG. 4 is a sectional view and shows another embodiment of a single-arm articulated jack.

In the embodiment of FIG. 4, the jack comprises a leg 11' with a pivoting foot 1' at the bottom. The upper end of leg 11' has an accommodation 32' for a rotating nut. The nut operates in conjunction with a spindle 9'. For simplicity, spindle 9' is represented only schematically and the nut not at all. Arm 4' is articulated to leg 11' by way of a horizontal axis 5' more than half-way up the leg. One end of spindle 9' engages arm 4', and an unillustrated crank is attached to the other end.

The main section 14' of arm 4' is straight, and an angled section 15' is applied to the arm's free end 6'. Accommodation 7' pivots around a bolt 16' that extends through the angled section 15' of arm 4'. Accommodation 7' engages the bottom of the vehicle's sill 17' when the vehicle is raised. Accommodation 7' engages the sill seam 18', ensuring unexceptionable contact between accommodation 7' and sill 17'. Main section 14' is a length of U-shaped section with a web 20' that connects two sides 23'. The angled section 15' is also a strip of sheet metal with an essentially U-shaped cross-section with sides 25' connected by a web 26'. The edges of sides 25' are reinforced with unillustrated flanges.

The lower end 28' of angled section 15' extends through a breach 29' in the web 20' of main section 14'. The angle between main section 14' and angled section 15' is secured with a hollow rivet 31' that extends through bores in both parts and fastens them together.

pivoting foot 1' is articulated to leg 11' by way of a bolt 33' and is provided with a base plate 2' that extends into a section 34' on each side. How far foot 1' tilts depends on the position of arm 4' in relation to leg 11'. The adjustment is carried out by a shaft 35' controlled by arm 4'. There is a straight row of teeth 36' at the top of shaft 35' that engage an arc of teeth 37' at the pivoting end of arm 4'. Rod 35' will accordingly slide along leg 11' as arm 4' pivots in relation to the leg. Inside leg 11', rod 35' rests against its web 38', where its longitudinal motion is guided and secured by means schematically represented.

The other end 39' of shaft 35' shift the base plate 2' of foot 1', adjusting the angle of application of leg 11' in relation to the initial weight-accommodating lift such that the jack will remain within the cone of friction during the whole jacking procedure within a wide range of vehicle-dictated lifts. Since shaft 35' is inside the leg, there will be less risk of contamination, and the user is less likely to be injured because the shaft cannot be accessed. The attachment between the angled section and the main section of the arm can be additionally ensured by screws, rivets, upsetting, or cementing.

We claim:

1. A jack comprising: an upright member standing on the ground; an arm articulated to said upright member and pivotable about a fixed horizontal axis; a spindle for raising and lowering said arm with respect to the ground; said arm having a free end bent upward to a vehicle to be raised by the jack; a pivotable carrying accommodation member on said free end; a sill seam engaged by said accommodation member, said accommodation member being pivotable about an axis located at least as high as said sill seam over a top side of a linear part of said arm; said arm having two parts, one of said parts being a base member extending linearly to said free end; the other part being an angled section form-fitted onto said free end.

2. A jack as defined in claim 1, wherein said linear part of said arm has recesses form-fitted by ribs on said angled section.

3. A jack as defined in claim 1, wherein said angled section has recesses form-fitted by ribs on said angled section.

4. A jack as defined in claim 1, wherein said linear part of said arm has recesses form-fitted by ribs on said linear part.

5. A jack as defined in claim 1, wherein said recesses and ribs snap together.

6. A jack as defined in claim 1, including fastening means for attaching said angled section to said linear part.

7. A jack as defined in claim 1, wherein said linear part and said angled section are of different materials.

8. A jack as defined in claim 1, including a foot member tilting around an axis at a bottom of said upright member and parallel to said fixed horizontal axis.

9. A jack as defined in claim 8, wherein said foot has a tilt dependent on a position of said arm.

10. A jack as defined in claim 8, including a shaft displaced by said arm, said foot having tilt dependent on a position of said shaft.

11. A jack as defined in claim 10, including a straight row of teeth on said shaft; and an arc of teeth on the end of said arm engaging said straight row of teeth.

12. A jack as defined in claim 10, wherein said shaft is inside said upright member.

13. A jack as defined in claim 10, wherein said shaft slides back and forth along said upright member.

14. A jack comprising: an upright member standing on the ground; an arm articulated to said upright member and pivotable about a fixed horizontal axis; a spindle for raising and lowering said arm with respect to the ground; said arm having a free end bent upward to a vehicle to be raised by the jack; a pivotable carrying accommodation member on said free end; a sill seam engaged by said accommodation member, said accommodation member being pivotable about an axis located at least as high as said sill seam over a top side of a linear part of said arm; said arm having two parts, one of said parts being a base member extending linearly to said free end; the other part being an angled section form-fitted onto said free end; said linear part of said arm having recesses form-fitted by ribs on said angled section; said ribs and recesses snapping together; fastening means for attaching said angled section to said linear part; said linear part and said angled section being of different materials; a foot member tilting around an axis at a bottom of said upright member and parallel to said fixed horizontal axis; said foot having a tilt dependent on a position of said arm; a straight row of teeth on a shaft; an arc of teeth on the end of said arm engaging said straight row of teeth; said shaft between said arm and said foot inside said upright member; said shaft sliding back and forth along said upright member.

* * * * *